United States Patent [19]

Bischof et al.

[11] Patent Number: 5,005,302

[45] Date of Patent: Apr. 9, 1991

[54] SYSTEM FOR HOLDING A FOOT IN A SKI BOOT

[75] Inventors: Horst Bischof, Graz; Wolfgang Skerbinjek, Baernbach, both of Austria

[73] Assignee: Koflach Sport Gesellschaft mbH & Co. KG, Voecklabruck, Austria

[21] Appl. No.: 279,067

[22] Filed: Dec. 2, 1988

[30] Foreign Application Priority Data

Dec. 3, 1987 [AT] Austria ..... 3194/87

[51] Int. Cl.[5] ..... A43B 5/04

[52] U.S. Cl. ..... 36/119; 36/117; 36/50

[58] Field of Search ..... 36/117–121, 36/50; 24/685 K

[56] References Cited

U.S. PATENT DOCUMENTS

| | | | |
|---|---|---|---|
| 4,577,421 | 3/1986 | Sartor | 36/119 |
| 4,593,483 | 6/1986 | Paris | 36/119 |
| 4,719,709 | 1/1988 | Vaccari | 36/117 |
| 4,785,555 | 11/1988 | Sartor | 36/119 |
| 4,811,503 | 3/1989 | Iwama | 36/119 |
| 4,893,419 | 1/1990 | Arieh et al. | 36/119 |

FOREIGN PATENT DOCUMENTS

| | | | |
|---|---|---|---|
| 0221483 | 5/1987 | European Pat. Off. . | |
| 0226857 | 7/1987 | European Pat. Off. . | |
| 3524792 | 1/1986 | Fed. Rep. of Germany | 36/119 |

*Primary Examiner*—Paul T. Sewell
*Assistant Examiner*—Ted Kavanaugh
*Attorney, Agent, or Firm*—Peter E. Rosden

[57] ABSTRACT

In a device for holding a foot in a ski boot with a tiltable cuff (2), a shell (3) overlapping the instep, and a projection (8) overlapping the heel area inside shell (3) or cuff (2), a flexible tensioning member (9) is disposed between cuff (2) or shell (3) and projection (8) overlapping the heel area, the free ends (10, 14) of said member running in the direction of the toe of the boot and mounted on shell (3) at a distance from the heel. One free end (14) of tensioning member (9) is then mounted in a lengthwise-adjustable manner, and this end or the other free end (10) of tensioning member (9) is mounted on a closing flap (11) on the front of the boot, especially on a component (6) which bears the attachment point for a toggle buckle (5). (FIG. 1.)

7 Claims, 2 Drawing Sheets

SYSTEM FOR HOLDING A FOOT IN A SKI BOOT

Figure 1:
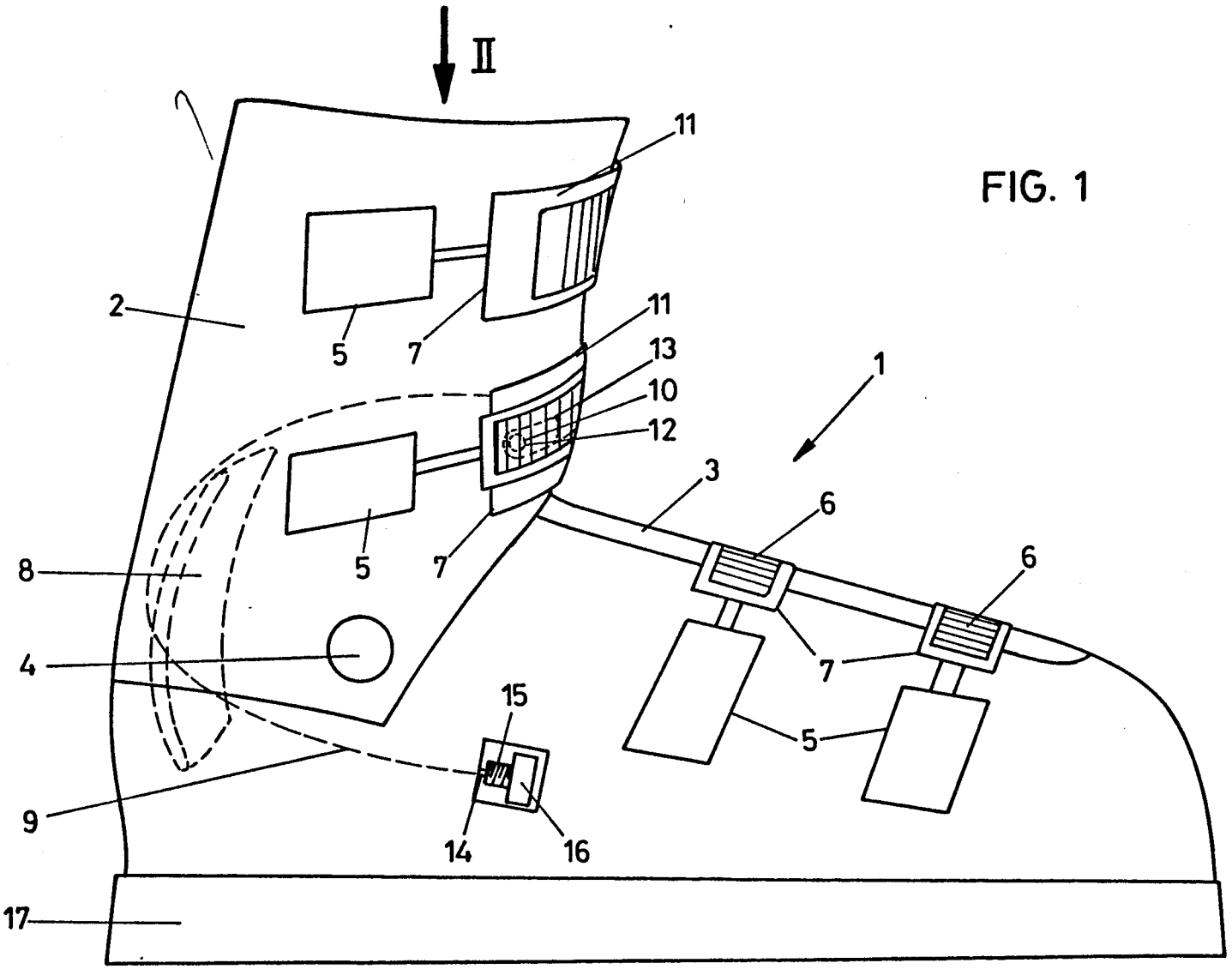

The invention relates to a device for holding a foot in a ski boot with a tiltable cuff, a shell overlapping the instep, and a projection inside the shell or cuff that overlaps the heel area.

Known ski boot designs are currently made as rear-entry boots with openable rear cuff part or as overlapping boots with provision for top entry into the boot. Even in classic overlapping boots, relatively free mobility of the cuff relative to the shell is allowed within certain limits, and a relatively large entry opening is provided as a rule even in overlapping boots to allow convenient entry into the boot. Due to the considerable mobility of the cuff relative to the shell and because of the wide opening required for convenient entry into the boot, a number of measures have already been proposed for improving the seating of the foot in the boot after the boot is closed. In particular, boots of this kind are usually made with a shoehorn-shaped part in the heel area of the boot and tensioning cables have been suggested for pulling the instep or metatarsus toward the heel area of the boot. However, because of the anatomical shape of the foot, when relatively large openings are provided for stepping into the boot, secure holding of the foot in the heel area is not ensured when the inside contour of the cuff in the heel area extends upward essentially in a straight line to facilitate entry.

The goal of the invention is to provide a boot of the type recited hereinabove, especially an overlapping boot of the type recited hereinabove, in which a correspondingly large opening for top entry can be provided and which nonetheless permits improved the holding of the foot in the heel area after the boot is closed. To achieve this goal, the design according to the invention essentially consists in disposing a flexible tensioning member between the cuff and shell and the projection overlapping the heel area, the free ends of said tensioning member extending toward the toe of the boot and being attached to the shell at a distance from the heel; one free end of the tensioning member can be adjusted in length and secured, and this end or the other free end of the tensioning member is secured to a closing flap on the front of the boot, especially to one of the attachment points for a component having a toggle buckle. The fact that, in contrast to known designs in which the instep or metatarsal area is pulled toward the heel, a tensioning member now ensures a better overlap of the projection located in the heel area and a better fit of this area against the heel, creates a seat for the foot in the boot that is better suited to the anatomical shape of the foot, said fit exhibiting a lower tendency to create undesired sensations of pressure on the foot. By adjusting the length of the flexible tensioning member at one free end of the flexible tensioning member, the adjustment for this member can be kept free of the tensile stresses that are exerted by toggle buckles in the metatarsal area when the boot is closed. Thus, correct closure of the boot in the metatarsal area and an independent anatomically correct fit to the heel area can be achieved by pulling on the heel tab. The fact that one of the two free ends of the tensioning member is mounted on a closing flap on the front of the boot, especially on a component that forms the attachment point for a toggle buckle, means that an especially simple design is created, in which one of the two free ends of the tensioning member is articulated to a flap that is tightly tensionable by a toggle buckle, so that when the toggle buckle is buckled only a relatively slight adjustment of the fit in the heel area occurs. The selected fit in the heel area is thus achieved completely independently of a more or less permanent closure in the metatarsal area. By mounting the other end on a closing flap, especially a toggle buckle, when the boot is opened a correspondingly large entry opening is ensured, and when the toggle buckle is buckled both a conventional holding of the foot in the cuff and a holding of the heel tab, adjusted by the selected length of the tensioning member and independently adjustable, are achieved.

In order to ensure an especially large entry opening into the boot when stepping into the latter, without having to change the preset adjustment of the fit in the heel area, the design is advantageously made such that the component connected to the tensioning member at the buckling flap is displaceably guided in an elongated hole. In this manner, after the toggle buckles are opened, the elongated hole permits further travel for the tensioning member which is available for entry, and the closing of the toggle buckles automatically restores the previously selected adjustment of the tensioning member, since the component displaceably guided in the elongated hole can only slide in the closing direction up to the specific limit of the elongated hole.

An especially simple adjustment and fitting capability for the fit in the heel area is effected by virtue of the fact that the free end of the tensioning member, mounted with provision for adjustment of its length, is provided with a threaded pin and cooperates with a spindle drive mounted on the shell, especially a nut mounted in a recess or hole in the shell. By means of such a device, which can be made relatively small, a considerable adjustment travel can be achieved without the shell of the boot having to be significantly enlarged.

In an especially simple fashion, the tensioning member can comprise a cable, since the corresponding pressure distribution is ensured by the flaps disposed in the heel area or the projection overlapping the heel area.

An especially uniform application of force over a large area can also be ensured by using cables for the tensioning member when the design is such that the free ends of the tensioning member terminate or are mounted on both sides of the central length of the boot at different distances from the sole. The tensioning member then surrounds the projection overlapping the heel area helically, thus permitting good pressure distribution without disadvantageous sensations of pressure.

The invention will now be described in greater detail with reference to one embodiment shown in the drawing.

Figure 2:
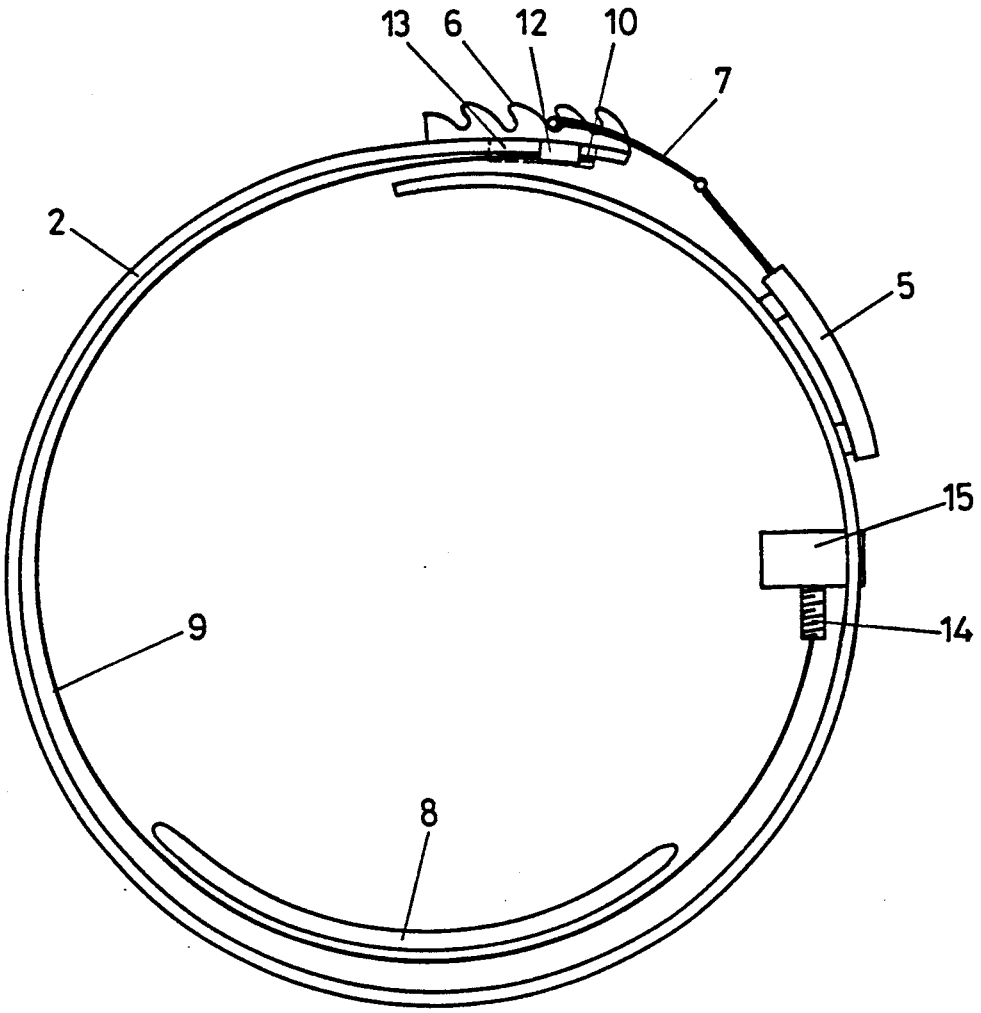

FIG. 1 is a schematic side view of a ski boot with the device according to the invention and FIG. 2 shows a view into the cuff of the ski boot according to FIG. 1.

The drawing shows a ski boot 1 which has a rear part or cuff 2 as well as a shell 3 which overlaps the metatarsal area or the instep area. An inner (liner) usually disposed inside such a boot 1 is not shown, for the sake of clarity. Cuff 2 is tiltable relative to boot 3 to a limited extent at a joint indicated schematically by 4. In the instep area, toggle buckles 5 mounted on shell 3 are shown, which hold the foot in the forward area of the ski boot by means of locking elements 6, likewise disposed on the shell and generally with a sawtooth shape, by means of tensioning loops 7. In addition, inside shell 3 or cuff 2, a projection 8 is indicated schematically in the heel area of ski boot 1, said projection overlapping the heel. A flexible tensioning member 9 is disposed between cuff 2 and shell 3 and projection 8 overlapping the heel area, said member 9 being indicated by the dashed lines in FIG. 1. One end 10 of the tensioning member, which can in particular comprise a cable, is mounted to a closing flap 11 on the front of the boot. Attachment point 12 is mounted in simple fashion on a component 6 which is essentially sawtooth-shaped, for an additional toggle buckle 5. Component 6, mounted with tensioning member 9 at articulation point 12 on closing flap 11, said component 6 cooperating with loop 7 of toggle buckle 5, is displaceably guided in an elongated hole represented schematically by 13, whereby advantages are obtained when a ski boot of this type is tightened. Cable 9 can be disposed in special guides inside cuff 2 or shell 3, to ensure the desired positioning of tensioning member 9, with these guides not being shown in FIG. 1, for the sake of clarity. The second free end 14 of tensioning member 9, in the embodiment in FIG. 1, has a threaded pin and cooperates with a spindle drive 15 mounted on shell 3, with this spindle drive being formed in simple fashion by a nut disposed in a recess 16 in shell 3. As is clearly evident from FIG. 1, the free ends 10 and 14 are mounted on both sides of the central length of boot 1 at mutually different distances from the sole 17 of the boot.

In the drawing shown in FIG. 2, the reference numbers of FIG. 1 have been retained. As is clearly evident from FIG. 2, flexible tensioning member 9 extends along the inner surface of cuff 2 or shell 3 between projection 8 overlapping the heel area and cuff 2 or shell 3. One free end 10 is in turn connected with component 6, which cooperates with toggle buckle 5, with articulation point 12 again being guided in an elongated hole 13 in cuff 2. The second end 14 is again formed by a threaded pin which cooperates with the nut shown schematically. The length of the tensioning member designed as a cable is changed by actuating nut 15, so that when tensioning member 9 is shortened, projection 8 which overlaps the heel area is pressed against the foot, with interposition of an inner (liner) not shown in greater detail. Thus, a change in the mounting of loop 7 on component 6 essentially does not produce any change in the length of tensioning member 9, since the movement of component 6, which cooperates with loop 7 of toggle buckle 5, is primarily converted into a movement in the lengthwise direction of the boot by reduction of the diameter of the opening in the cuff and only secondarily is converted into a movement of component 6 in the circumferential direction of the cuff. An adjustment of the length of cable 9, selected by operating nut 15, for holding the heel area of a foot in a ski boot is thus not changed by actuating the toggle buckle, which cooperates with articulation point 12 of the second free end of tensioning member 9. Thus, the heel tab or projection 8 overlapping the heel area can be tightened without changing the overall fit in the metatarsal area.

We claim:

1. A system for securely and comfortably holding a foot in a boot when the boot is closed, particularly in the heel and instep regions, comprising:

a shell covering at least the instep region of the foot;

a cuff part tiltably attached to said shell having a generally curved shape;

a sole attached to said shell;

a projection part located between the heel region of the foot on one side and said shell and said cuff part on the other side;

tension means for drawing said projection part towards the heel region of the foot when the boot is closed while simultaneously exerting minimal pressure on the instep region of the foot wherein said tension means includes a first free end extending forward from the heel area of the boot aross the front of said cuff part and a second free end extending forward from the heel area of the boot along the side of said shell;

closing flap means at the front of said cuff part to which the first free end of said tension means is movably attached for selecting and controlling the forces to be applied to said cuff part and for regulating the movement of the first free end during closing of said cuff part; and adjustment means fixed to said shell at a point spaced forward of the heel region along the length of the boot in the direction of the toe region wherein said second free end is attached to said adjustment means for selectably changing the force applied by said tension means to said projection part by altering the length of said tension means without significantly affecting the forces applied to said cuff part by said closing flap means.

2. The system of claim 1, wherein said closing flap means comprises:

a toggle buckle having a loop attached thereto;

locking element means for closing the top part of the boot through cooperation with the loop of said toggle buckle wherein said locking element means operates circumferentially around said cuff part;

attachment means fixed to said locking element means for attaching the first free end to said locking element means;

guide means for limiting the circumferential movement of said locking element means around said cuff part and for causing a reduction in the diameter of said cuff part during closing of the top part of the boot.

3. The system of claim 2, wherein said guide means comprises an elongated opening in said cuff part through which the first free end freely extends but which is smaller than said attachment means to permit a known, limited amount of movement by said attachment means.

4. The system of claim 2, wherein the second free end includes a threaded pin and said adjustment means comprises spindle drive means mounted on said shell for cooperating with the threaded pin.

5. The system of claim 4, wherein said spindle drive means is formed by a nut disposed in a recess in said shell.

6. The system of claim 5, wherein said tension means is a cable.

7. The system of claim 6, wherein the first and second free ends are mounted on opposing longitudinal sides of the boot and at different vertical distances from said sole.

* * * * *